US005473989A

United States Patent [19]

Buc

[11] Patent Number: 5,473,989

[45] Date of Patent: Dec. 12, 1995

[54] FIN-STABILIZED DISCARDING SABOT PROJECTILE

[76] Inventor: Steven M. Buc, 53 Lake Park Ct., Germantown, Md. 20874

[21] Appl. No.: 393,818

[22] Filed: Feb. 24, 1995

[51] Int. Cl.[6] ..... F42B 14/06

[52] U.S. Cl. ..... 102/521; 102/513; 102/517

[58] Field of Search ..... 102/520–527, 102/703, 513

[56] References Cited

U.S. PATENT DOCUMENTS

| | | | |
|---|---|---|---|
| 3,107,615 | 10/1963 | Brady | 102/521 |
| 3,111,902 | 11/1963 | Taylor | 102/94 |
| 3,262,391 | 7/1966 | Shober | 102/521 |
| 3,620,167 | 11/1971 | Romer et al. | 102/521 |
| 3,695,181 | 10/1972 | Bull et al. | 102/521 |
| 3,738,279 | 6/1973 | Eyre et al. | 102/521 |
| 3,853,057 | 12/1974 | Rickert et al. | 102/521 |
| 4,029,018 | 6/1977 | Björnson | 102/93 |
| 4,362,107 | 12/1982 | Romer et al. | 102/520 |
| 4,372,217 | 2/1983 | Kirkendall et al. | 102/521 |
| 4,384,529 | 5/1983 | Burns et al. | 102/520 |
| 4,608,927 | 9/1986 | Romer et al. | 102/521 |
| 4,823,703 | 4/1989 | Donaldson | 102/521 |
| 4,920,889 | 5/1990 | Luther | 102/521 |
| 5,097,766 | 3/1992 | Campoli et al. | 102/513 |
| 5,297,492 | 3/1994 | Buc | 102/521 |
| 5,359,938 | 11/1994 | Campoli et al. | 102/521 |

*Primary Examiner*—Harold J. Tudor

[57] ABSTRACT

An improved small caliber armor piercing projectile (10) having a fin stabilized sub-caliber high density rod penetrator (11) and an adequately large tracer cavity (23). The tracer cavity does not degrade the armor penetrating capability of the projectile. The rod penetrator core is supported structurally during gun launch by a minimum weight segmented sabot (13) which engages the barrel rifling, followed by a solid plastic obturator (15) which provides an uninterrupted gas seal and holds the segmented sabot components together around the rod penetrator prior to launch. The solid obturator is made from a low ductility homogenous plastic or plastic reinforced composite and is blown apart upon muzzle exit by entrapped propellant gas pressure retained in an internal aft cavity (19). The plastic obturator are located behind the structural sabot so that the propellant gas pressure will maintain the obturator under hydrostatic compression while in the barrel to ensure projectile in-bore stability. Upon muzzle exit, the fractured obturator and segmented sabot components freely discard from the flight projectile without introducing trajectory disturbances.

8 Claims, 2 Drawing Sheets

FIN-STABILIZED DISCARDING SABOT PROJECTILE

BACKGROUND OF THE INVENTION

1. Field of the Invention

The invention relates to discarding sabot projectiles, and more specifically to sub-caliber fin-stabilized armor penetrating projectiles, which contain therein rod penetrator cores, and an integral tracer of suitable pyrotechnic composition.

2. Description of the Prior Art

Three types of armor piercing projectiles are currently utilized in small caliber gun systems. One of the designs is of a conventional projectile shape and is full-bore diameter, consisting of a combination of high strength steel or high density material as a penetrator swaged or inserted into a suitable jacket or sleeve material. At the projectile base is an opening for a tracer cavity of adequate depth and diameter to provide a clear visual trace of the entire projectile trajectory. This type of full-bore projectile utilizes the high density or high strength penetrator and to some extent the jacket or sleeve material and its geometry to affect armor penetration. This type of projectile has severely limited armor penetration capability at target engagement ranges beyond several hundred meters, due to its high drag configuration.

It has been demonstrated that sub-caliber high density rod type penetrators are capable of penetrating significantly more armor than the full-bore projectiles at target ranges beyond several hundred meters. This is due to the high density rod's more efficient armor penetration geometry and the greater mass per cross sectional area of the sub-caliber rod flight projectile, which results in it losing less velocity from aerodynamic drag. To take advantage of the rod's high ballistic coefficient and to provide increased initial launch velocities, sabots were designed to encapsulate the rod penetrator during handling, storage, and gun firing, and to discard shortly after exiting the muzzle, thus allowing only the rod penetrator to continue in flight toward the target. One type of discarding sabot projectile has been demonstrated in small caliber guns to provide increased armor penetration over full-bore projectiles. This is the Armor Piercing Discarding Sabot (APDS) projectile, which utilizes a spin stabilized sub-caliber penetrating core as the flight projectile. APDS projectiles using high density rod penetrators have been developed for guns from caliber 5.56 millimeter through caliber 120 millimeter. Given aerodynamic considerations, APDS projectile designs below caliber 25 millimeter do not allow the inclusion of a tracer cavity without degrading penetrator performance. The tracer cavity in these projectiles significantly reduces the available high density rod material required for armor penetration.

It has been demonstrated that armor piercing fin stabilized discarding sabot (APFSDS) projectiles penetrate more armor at greater ranges than spin stabilized APDS projectiles, due to the longer allowable penetrator lengths that can be launched and flown to the target with accuracy and stability. APFSDS projectiles utilizing high density sub-caliber rod penetrators have been developed for both rifled barrel and smooth bore guns from caliber 25 millimeter through 140 millimeter, and these designs have permitted the incorporation of an adequate tracer cavity in the rear of the flight projectile without degradation of the rod's armor penetration performance. Flechette type APFSDS projectiles utilizing high strength or high density rod penetrators have been developed for small caliber 5.56 and 7.62 millimeter rifle systems, but without allowance for a tracer cavity in the flight projectile.

Fin stabilized APFSDS projectile designs incorporating an adequate tracer cavity and developed for larger caliber systems do not efficiently scale down to small caliber projectiles due to the complexity of their sabot geometries which were optimized for the unique parameters of the larger caliber systems. Early fin stabilized APFSDS projectile designs for smaller caliber 5.56 and 7.62 millimeter guns did not provide for a tracer cavity in the rear of the flight projectile.

A more effective and efficient fin-stabilized, discarding sabot projectile incorporating an adequate tracer cavity with a deep armor penetrating projectile for small arms applications has been disclosed in U.S. Pat. No. 5,297,492 (Buc). This design overcomes many of the shortcomings inherent in earlier small arms APDS and APFSDS projectiles, such as: faulty structural design, poor sabot discard, reduced projectile accuracy at long range, low muzzle velocity due to high sabot parasitic weight, and inadequate armor penetration. Although a good start in the right direction for small caliber APFSDS projectiles, this design requires the use of several high precision manufactured obturator components, to ensure adequate performance and safety reliability. Reducing the complexity of the current state-of-the-art in obturator design will result in greater projectile performance, achieved with less expensive components, assemblies, and manufacturing processes.

Accordingly, it is advantageous to provide an armor piercing fin stabilized discarding sabot (APFSDS) projectile for small caliber guns which minimizes sabot parasitic weight and structural complexity, facilitates rapid sabot separation upon muzzle exit without introducing trajectory inaccuracies for the rod projectile, maximizes armor penetrator weight and length, and provides for an adequate tracer cavity in the rear of the flight projectile.

SUMMARY

Several objects and advantages of my invention are to provide a small caliber Armor Piercing Fin Stabilized Discarding Sabot Tracer (APFSDS-T) projectile which overcomes the problems set forth in detail herein above.

The projectile assembly of this invention is made up of a sub-caliber high density rod penetrator of length substantially longer than its external diameter, with an internal tracer cavity in the based portion, an external threaded or grooved region along the central portion of its long axis, and aerodynamic contouring of the forward nose portion; a stabilizing fin appendage of substantially full-bore diameter with a through-hole along its central axis to provide for continuation of any tracer cavity and for affixing to the aft portion of the rod penetrator; a segmented structural sabot of low density metallic material with an internal threaded or grooved cavity along its symmetric axis for attachment to the rod penetrator; the sabot is of length less than or equal to its external diameter, with a central bulkhead region of substantially full-bore diameter which engraves into the barrel rifling, a tapered concave ramp aft of the bulkhead, and a substantially equal length tapered concave ramp forward of the bulkhead; behind the sabot is a solid, continuous, unsegmented low density plastic obturator of substantially full-bore diameter which engraves into the barrel rifling and has a forward tapered surface for mating with the tapered aft ramp of the sabot with an interference fit, and a through-hole along its central axis with internal diameter slightly less than the external diameter of the rod penetrator for an interference fit. This solid obturator has an aft opening internal cavity for trapping propellant gases during firing.

In the present series of discarding sabot projectiles for small arms applications, to facilitate obturator separation without introducing trajectory inaccuracies for the rod projectile, obturator components are segmented longitudinally into equal parts, or longitudinally notched at uniform intervals to provide fracture points. These early design approaches have been used with the understanding that small caliber rifle barrels impart insufficient spin and muzzle gas pressure to cause a solid mass of obturator material to fracture upon release from the barrel confines. For this reason, obturators are segmented, or notched to create a lower fracture threshold in previous inventions.

Notching plastic obturators has been shown to be a serious disadvantage in previous discarding sabot designs, resulting in faulty structural integrity, poor sabot and obturator discard and poor trajectory accuracy. Notched obturators and sabots are typically placed forward of the surface upon which the propellant gas pressure acts. In other words, the structure is not under hydrostatic pressure. Orthogonal states of stress are not equal, and should the material fail, a crack could propagate to catastrophic proportions. Notched structural components cannot be placed under hydrostatic pressure, since the notch removes some material. Under hydrostatic pressure, the material will fail and flow into the notched area, resulting in the structure collapsing under the load.

Segmenting is very different from notching. Segmenting slices the material, but does not remove material, as does a notch. A structure may be either partially or completely segmented through its section, depending on the strength requirements. A segmented structure will not collapse, and a crack will not propagate under hydrostatic pressure, since there is no where for the material to flow. However, when not subjected to hydrostatic pressure, a partially segmented structure may behave similarly to a notched structure.

When a plastic obturator or sabot is notched or partially segmented, the structural component is being required to perform contradictory functions. Theoretically, the notch or partial segmenting introduces a predetermined fracture point, with a fracture strength less than the adjacent material. This fracture point, however, must still withstand the rotational forces imparted to the structure during down-bore travel. Upon muzzle exit, this same structure fractures at the notch or segment due to the same rotational forces, once the confines of the barrel are removed. Unfortunately, the rotational forces are a maximum at the muzzle, where the spin rate is a maximum. And since the structure is supposed to not break in the barrel under the same spin rate induced forces that break it outside of the barrel, the structural demands placed upon the notch or partial segment are mutually exclusive. The structure must either break in the barrel, exactly at the muzzle, or not at all.

If the structure does not break prior to muzzle exit, ram air forces will eventually strip if off of the sub-projectile. However, serious trajectory disturbances will result. If the structure breaks prior to muzzle exit, the sub-projectile may dislodge from the sabot or obturator and damage the barrel. At a minimum, in-bore failure will result in poor trajectory accuracy. It is a statistical impossibility to design the fracture point to fail exactly at the muzzle every time under all conditions of operation and material quality variations. Therefore, notching or partially segmenting structural components under the notion of easing sabot discard is a faulty design practice.

The effective solutions involve placing a solid un-segmented obturator, or a combination of fully segmented and un-segmented obturator components behind a segmented structural sabot, where the obturator is subjected to hydrostatic pressure so that the material will not flow and fracture, and where there is an independent mechanism, trapped propellant gas, to fracture a solid obturator component upon muzzle exit.

Fully segmenting portions of obturator components reduces the sabot and obturator discard problems, but introduces design, manufacturing, and assembly complexities. In U.S. Pat. No. 5,297,492 (Buc), to retain the segmented portions of the sabot and forward components of the obturator prior to launch, the aft portion of the obturator is a solid plastic ring which mates over the aft portion of the segmented obturator components. This obturator ring has an aft cavity which retains propellant gas pressure and expands radially to seal against the barrel wall during launch. Upon muzzle exit, the entrapped gas pressure is sufficient to fracture this solid obturating ring permitting it and the other obturator and sabot components to separate freely from the rod projectile.

This approach of segmenting some of the obturator components, while incorporating a solid, unsegmented obturator ring to retain the segmented components during launch, has been shown to be functional and effective when using a certain class of plastic obturator materials. Homogenous plastic materials, such as those known under commercial names as Nylon, Delrin, Lexan, Ultem, and others which have a strain elongation to failure from twenty-five to seventy-five percent work well in this obturator design. One of the most important properties in the proper selection of obturator material is that it has an ultimate failure elongation less than approximately seventy-five percent. The reason for this is that the solid obturator ring must not break too late after muzzle exit. The more ductile the material, or the higher its elongation to failure, the more time it requires to strain and break due to the entrapped muzzle gas pressure. Using these materials, the obturator must be segmented in the forward region, since spin rates and entrapped muzzle gas pressure are insufficient to overcome the strength and elasticity of these homogeneous plastic materials if used unsegmented. However, these materials are sufficiently weak so that the small solid plastic obturator will quickly fracture due to entrapped propellant gas upon muzzle exit.

It is not possible, however, to use such ductile plastic materials in an obturator design which eliminates the forward segmented components. A fully solid, unsegmented plastic obturator, using these ductile materials and this previous design, will not fracture upon muzzle exit, when fired from a small caliber rifle, resulting in poor projectile accuracy and reduced effective range.

It is advantageous, therefore, to develop an obturator design, for small caliber rifle application, which incorporates a much more simplified obturator assembly, eliminating segmented obturator components and the solid obturator retaining ring, yet results in clean sabot and obturator separation and reduced trajectory disturbances to the flight projectile.

A solid, unsegmented obturator design and material combination has been achieved in this invention. Unlike the present series of discarding sabot projectiles, this invention places a solid, one piece plastic obturating material aft of the structural sabot where it is subjected to the high propellant gas pressures during travel down the barrel. In this configuration, the plastic material behaves as a fluid would behave under hydrostatic pressure. Under hydrostatic pressure, the plastic material can fail structurally, but a crack cannot propagate since the three orthogonal components of the state of stress are equal and under compression. The preferred materials for use in a one piece solid obturator in this design are reinforced plastic composites, and very low elongation homogenous plastic materials.

Reinforced plastic composites exhibit ideal mechanical properties for use in a one piece, solid obturator. Reinforced composites have high compression and tensile strength, yet very low elongation to failure, most of them from one to three percent strain. Plastic composite materials which function well in this design include those known commercially as Linen-Phenolic, Fiber Glass, Glass-Filled Nylon, Glass-Reinforced Nylon, Glass-Reinforced Ultem (polyetherimide), Glass-Filled PEEK (polyetheretherketone) Resin, Glass-Reinforced Polycarbonate, Glass-Reinforced Polyester, Glass-Reinforced Polyethylene, Fiber Reinforced Epoxy, Fiber Reinforced Thermoplastic and others with a strain to failure of less than twenty-five percent elongation. Homogenous plastic materials which have high strength, advantageously low elongation to failure, and are suitable for use in this invention, include commercially known plastics such as Acrylic, Torlon (polyamide-imide) Epoxy, Thermoplastic, and Phenolic, and others with a strain to failure of less than twenty-five percent elongation. The use of low elongation to failure homogenous plastic and plastic composite materials permit the simplification of discarding sabot obturator design and complexity, while ensuring in-bore structural integrity and stability, and clean sabot separation upon muzzle exit. For these reasons, this invention provides unique, unexpected, and useful results applicable to small caliber discarding sabot projectile design.

It is an objective of this invention to provide a subcaliber fin-stabilized, armor piercing, discarding sabot projectile which incorporates a lightweight one-piece, continuous, solid obturator which engages the barrel rifling and is located aft of the structural sabot.

These and other objects of the invention will be better understood by reference to the following detailed descriptions, accompanying drawings, and claims.

BRIEF DESCRIPTION OF THE DRAWINGS

The specification concludes with a claim particularly pointing out and distinctly claiming the subject matter of the present invention. However, it is believed that the invention will be better understood from the following description taken in connection with the accompanying drawings in which:

DESCRIPTION OF THE PREFERRED EMBODIMENTS

Figure 1:
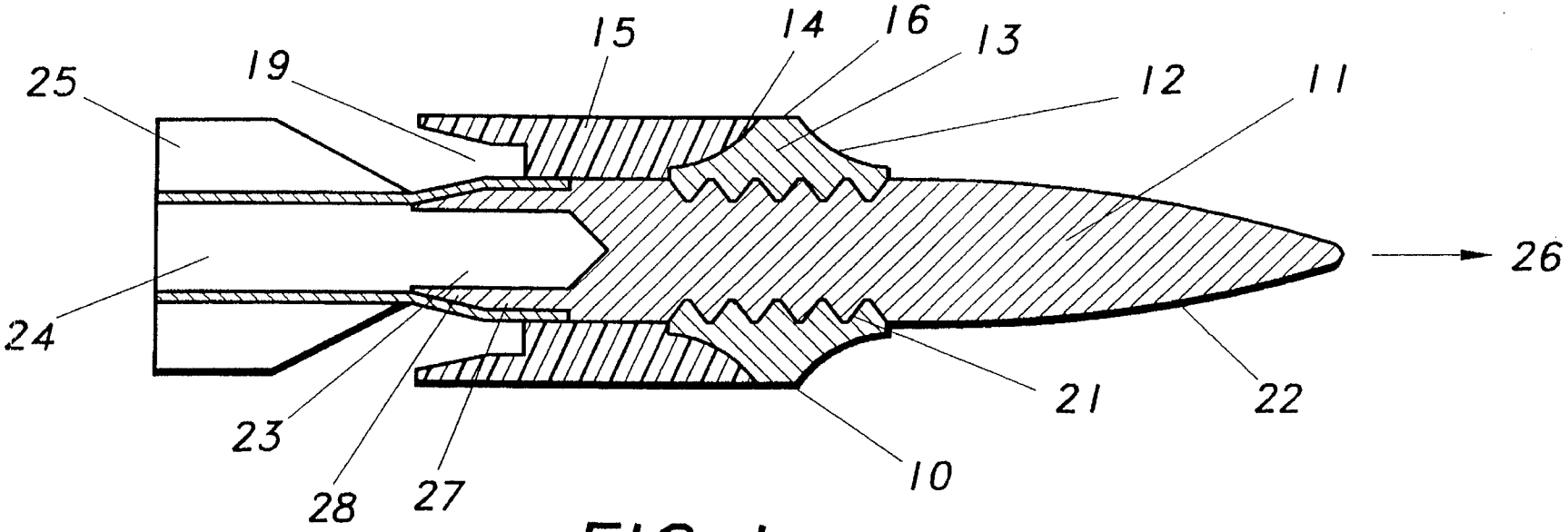
FIG. 1 is a cross-sectional view of one embodiment of the invention.

FIG. 1 shows a cross-sectional view of my invention, an armor piercing fin stabilized discarding sabot tracer (APFSDS-T) projectile 10, providing an advantage not heretofore obtained in small caliber gun systems with the present series of discarding sabot projectiles. The major components or parts of this new projectile include an elongated rod penetrator core 11, made of high density material such as tungsten alloy, depleted uranium alloy, or hard steel. With respect to travel direction 26, attached to the rear portion of the penetrator core with a suitable interference fit is a stabilizing fin appendage 25. The interference fit is provided by conical boattail section 28 and a lesser diameter cylindrical section 27 at the rear of the rod penetrator. The boattail section allows for reduced aerodynamic base drag. Sub-caliber flight projectile 22 is the assembly of the rod penetrator and the stabilizing fins. The stabilizing fins are made of high strength aluminum or steel. In the base portion of the rod penetrator is a tracer cavity 23, which is filled with a suitable pyrotechnic composition. The fin appendage contains a through-hole 24 for continuation of the tracer cavity. Attached to the outside of the penetrator core with a threaded or grooved interface 21 is a segmented structural sabot 13. The segmented sabot is made from strong, low density material such as aluminum or magnesium alloy, and is segmented longitudinally into a plurality of equal parts. The segmented sabot has a central bulkhead region 16 of diameter sufficient to permit it to engage the barrel rifling, flanked by a concave aft sabot ramp 14 and a concave front sabot ramp 12. These ramps are concave in form to give the sabot the lowest weight and highest strength combination for the launch mass and acceleration of the rod penetrator. The concave aft ramp also provides a strong interlocking surface with the aft obturator component. The aft sabot ramp is of substantially equal length to the front sabot ramp so that the total sabot weight is minimized. Located behind the sabot is a solid obturator 15. The solid obturator is made from low density material such as a reinforced plastic composite or a homogenous plastic material with an ultimate failure strain of less than twenty-five percent elongation. The external diameter of solid obturator 15 is sufficient to permit; it to engage the barrel rifling. The forward convex surface of the solid obturator mates with the concave aft sabot ramp. The internal cylindrical surface of the solid obturator mates with the external surface of the rod penetrator with a tight interference fit, forming a continuous gas seal around the projectile base from the bore to the rod penetrator. An aft cavity 19 is provided opening to the rear in the solid obturator to entrap propellant gas pressure during down-bore travel to seal the barrel during launch and to fracture the obturator material when the projectile is free of the barrel muzzle. Sufficient in-bore stability for the projectile during launch is provided by the combined bore-riding lengths of the solid obturator and the segmented sabot. As shown in FIG. 1, the obturator 15 has a bore-riding surface having a length greater than its bore diameter. The external diameters of the solid obturator and segmented sabot are sufficiently full-bore to permit each to engage the barrel rifling to provide tight in-bore integrity of the projectile.

Figure 2:
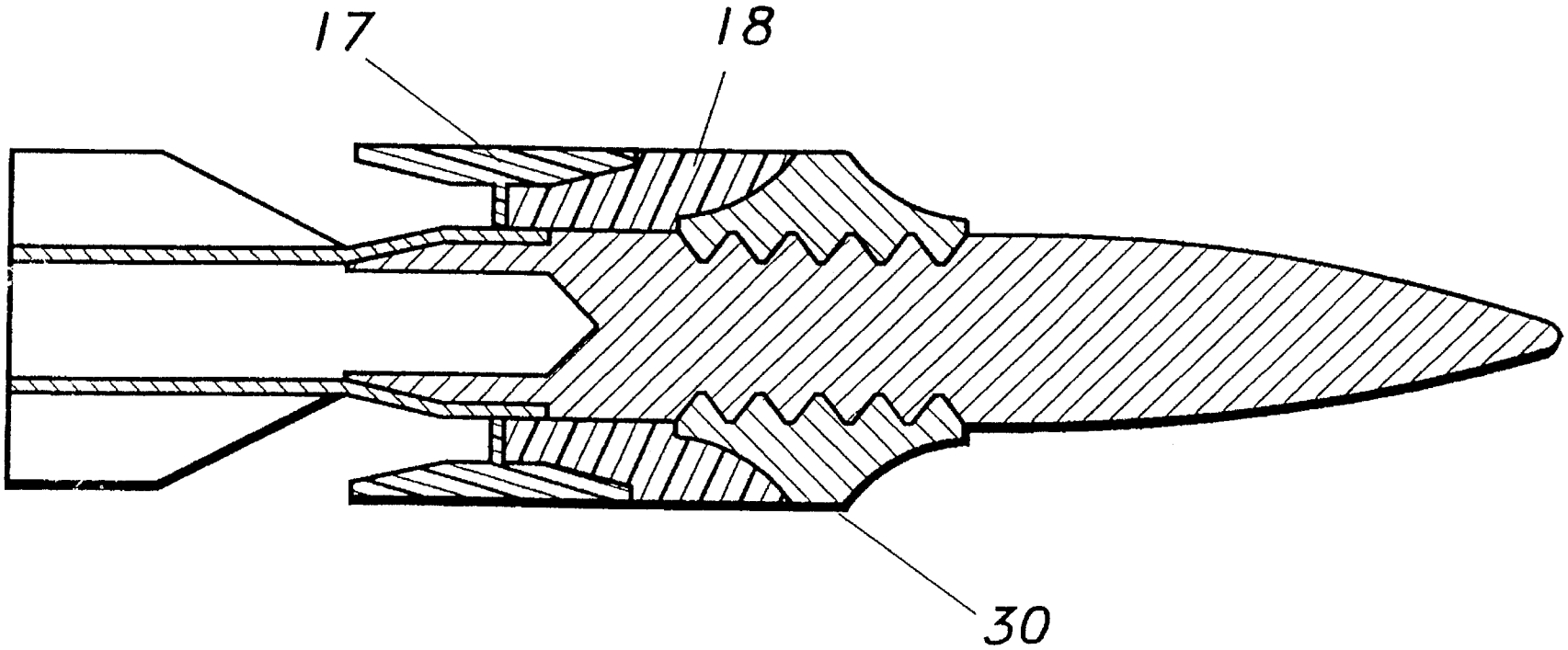
FIG. 2 PRIOR ART
FIG. 2 is a cross-sectional view of a prior Armor Piercing Fin Stabilized Discarding Sabot Tracer (APFSDS-T) Projectile which incorporates a segmented plastic obturator behind a segmented structural sabot. All segmented components are held in place during down-bore travel by a solid plastic obturator ring.

FIG. 2 shows a cross-sectional view of an existing APFSDS-T projectile 30 which does not provide the advantages heretofore obtained with my invention. The projectile in FIG. 2 utilizes a multipiece plastic obturator assembly, comprised of forward segmented plastic obturator 18, followed by an aft solid obturator ring 17. The use of this multipiece obturator assembly is required to ensure in-bore structural integrity of the sabot and obturator components and proper obturator and sabot discard when using obturator materials with an ultimate strain to failure of greater than twenty-five percent elongation. The use of more brittle obturator materials, those with less than twenty-five percent elongation to failure in the solid obturator ring results in premature obturator failure during launch, resulting in the loss of in-bore structural integrity, low muzzle velocity, and poor accuracy. The use of too ductile an obturator material in this configuration, those materials with greater than seventy-five percent elongation to failure, results in the solid obturator ring stretching and venting the entrapped propellant gas pressure. As the entrapped propellant gas pressure vents, the solid obturator ring may not fracture before it can clear the stabilizing fin appendage. If the solid obturator ring stretches, but does not fracture, and impacts the fins, the projectile trajectory will be disturbed, resulting in loss of accuracy.

Although this prior design can be made to function safely and reliably using a precisely defined range of ductile obturator materials, the use of this multipiece obturator is more costly in terms of the required manufacturing and assembly processes which ensure the necessary high quality control. Ensuring that obturator material ductility specifications are achieved and maintained within the required range during all phases of manufacturing and storage also adds considerable quality control costs.

My invention, by simplifying the obturator assembly and lowering the material ductility requirements to that of a very brittle material, contains the necessary design and material improvements to make an APFSDS-T projectile fully functional, less expensive to manufacture and inspect to high standards of quality control, and a more cost effective armor penetrator in small caliber guns.

Operation of the Invention

When the invention, projectile 10 as shown in FIG. 1, is fired in a gun, the expanding propellant gases exert a positive force on the projectile base. The material mass per base area of rod penetrator 11 is greater than the combined material mass per area of solid obturator 15 plus segmented sabot 13. This mass per area imbalance results in a positive traction force in interface 21 between the rod penetrator and the sabot. The material strengths and groove form are chosen such that the interface will not fail in shear and allow the sabot and penetrator to move relative to each other in the longitudinal direction. This results in the sabot and the rod penetrator traveling down-bore as an assembled unit. The gun barrel prevents the sabot segments from moving radially outward away from the rod penetrator during down-bore travel. The gas pressure which forces the projectile down-bore forces solid obturator 15 forward against sabot 13, as all components travel down-bore. As the projectile begins its down-bore travel, sabot bulkhead 16 engages the barrel rifling developing a radially compressive force keeping it in tight contact with rod penetrator 11. Similarly, solid obturator 15 engages the barrel rifling developing a radially compressive force keeping it in tight contact with the sabot and the rod penetrator. As the obturator is forced forward, concave aft sabot ramp 14 forces solid obturator 15 to ride radially outward ensuring positive radial pressure against the barrel wall thus providing a tight assembly against the sabot and penetrator and a seal against the propellant gas pressure.

When the projectile exits the barrel muzzle, the trapped gas pressure in cavity 19 causes solid obturator 15 to fracture radially outward away from rod penetrator 11, since the gun barrel is no longer present to restrict radial movement. The fracture of the relatively long and thick obturator section is achieved due to the very low ultimate strain to failure of the obturator material. The sabot components are already segmented so no additional breaking of materials is required, and the tangential spin velocities result in fractured obturator and segmented sabot components flying free of the rod penetrator. The fin stabilized sub-caliber rod penetrator is now free to fly undisturbed towards its target.

Conclusions, Ramifications, and Scope of Invention

The projectile of the invention provides an improved, highly efficient, low mass-energy loss discarding sabot of high in-bore stability and high trajectory accuracy, for a superior sub-caliber armor penetrating rod with simplified component assemblies, for use in small caliber gun systems.

It is intended that my invention be utilized in a wide range of small caliber guns of bore diameter less than or equal to 25 millimeters, for which it is a more efficient armor piercing projectile design. While my above description contains many preferred specificities, these should not be construed as limitations on the scope of the invention, but rather as an exemplification of one preferred embodiment thereof. For example, the threaded or grooved interface between the sabot and the rod penetrator can have more or less grooves or threads of different pitch, depth and form. The sabot can be segmented longitudinally into two, three, or more equal parts. The sabot material can be aluminum alloy or lower density magnesium alloy depending on the gun system used. The penetrator may be of steel, tungsten alloy or depleted uranium alloy depending on the gun system and the targets under consideration. The one piece solid obturator can be of different length depending on the projectile caliber and can have more or less of a pressurized obturator cavity depending on the barrel pressures of the gun system under consideration. The fin stabilization can be exchanged with a cone stabilizer depending on the launch velocity of the gun system under consideration. A cone or flare stabilizer is a conical tapered appendage which provides unique stability characteristics depending on flight Mach number. The use of the boattail may not necessarily be required, depending on the caliber of the projectile under consideration, and the desired aerodynamic performance characteristics. The interference press fit connection between the fin appendage and the rod penetrator may also be substituted with a threaded connection, depending on the caliber of the projectile and the cost of suitable manufacturing processes. The use of the tracer cavity in the rod penetrator and the fin appendage is optional, depending on the desired performance characteristics of the cartridge and whether a trajectory trace is desired. The nose of the penetrator rod can have a different aerodynamic contour, from tangent ogive to straight cone, depending on the desired aerodynamics of the flight projectile. Other streamlining aspects of the rod penetrator can also be modified as required by the gun system application. The segmented structural sabot bulkhead does not always need to be located between two equal length sabot ramps. The front and aft ramps may be of different length and contour. This contour may be concave, a series of one or more straight sections, or convex, depending on the unique requirements of the cartridge and weapon system. However, the preferred embodiments of concave and equal length sabot forward and aft ramps yields the minimum weight and maximum structural performance combination.

Efficient armor piercing projectile design involves a careful balance of many gun and armor target parameters, which are unique to each system under consideration. Nevertheless, certain critical design practices apply across the boundaries of small caliber gun systems. These practices include the need to incorporate a tracer cavity of adequate diameter and depth for the eye to track the trajectory of the sub-caliber projectile; the tracer cavity cannot detract from the armor penetrating potential of the rod penetrator; the segmented sabot weight is minimized for its in-bore stability and structural requirements; and the projectile obturation provides adequate propellant gas sealing and still separates cleanly from the rod projectile without introducing trajectory disturbances, once free from the barrel.

To accomplish these requirements in small caliber projectiles, the rod penetrator is made longer to accommodate the tracer cavity so that removal of high density or high strength armor penetrating material is unnecessary. Making the rod longer to accommodate the tracer cavity requires that the rod penetrator be fin stabilized. Minimizing the segmented structural sabot weight requires a sabot design which is of length less than its bulkhead diameter, and has forward and aft sabot ramps which are concave and of substantially equal length. Clean separation of the projectile obturator upon muzzle exit requires that the obturator components be designed with specific attention to the unique structural and mechanical characteristics of candidate materials. Different classes of obturator materials perform better depending on the obturator design and projectile assembly. Reducing the cost of manufacturing, assembly, and inspection of high quality discarding sabot projectiles depends on developing designs utilizing a minimum number of components and processes, and simplifying obturator design greatly reduces the manufacturing costs of discarding sabot ammunition. The invention is the embodiment of these design practices for armor piercing projectiles for use in small caliber gun systems.

I claim:

1. A discarding sabot projectile comprising:

a sub-caliber rod penetrator having an outer surface, having a central cylindrical region; said central cylindrical region having a grooved interface;

a metal sabot disposed circumferentially about said central cylindrical region said sabot having a sabot aft ramp, having only one sabot bulkhead having a bore-riding surface, and having a sabot front ramp; said sabot is segmented longitudinally into a plurality of parts; and a solid one-piece continuous plastic obturator having a bore-riding surface defining a bore diameter and having a length greater than said bore diameter; said solid obturator having an internal surface mating with said outer surface of said sub-caliber rod penetrator and having a forward surface mating with said sabot aft ramp; said forward surface having interlocking means with said sabot aft ramp; said solid obturator having an internal aft cavity formed by an inner surface of said solid obturator and said outer surface of said sub-caliber rod penetrator; said internal aft cavity serving to entrap propellant gas pressure to facilitate fracture of the solid obturator upon muzzle exit; said plastic obturator formed of a plastic having an ultimate strain to failure less than twenty-five percent elongation.

2. The discarding sabot projectile as defined in claim 1 wherein said solid obturator is made from material selected from the group consisting of homogenous plastics and plastic composites.

3. The discarding sabot projectile as defined in claim 1 wherein said sub-caliber rod penetrator is made from material selected from the group consisting of tungsten alloys, depleted uranium alloys, and steels.

4. The discarding sabot projectile as defined in claim 1 wherein said sabot is made from material selected from the group consisting of aluminum alloys and magnesium alloys.

5. The discarding sabot projectile as defined in claim 1 wherein said solid obturator is made from material selected from the group consisting of linen-phenolic, fiber glass, glass-filled nylon, glass-reinforced nylon, glass-reinforced polycarbonate, glass-reinforced polyester, glass-reinforced polyethylene, fiber reinforced epoxy glass-reinforced polyetherimide, glass-filled polyetheretherketone resin, acrylic, and polyamide-imide.

6. The discarding sabot projectile as defined in claim 1 wherein said sub-caliber rod penetrator has a rearward opening tracer cavity; said sub-caliber rod penetrator further including a means for aerodynamic stabilization located at the aft end of said sub-caliber rod penetrator; said means for aerodynamic stabilization having a through-hole providing increased tracer cavity depth.

7. The discarding sabot projectile as defined in claim 1 wherein said sabot aft ramp and said sabot front ramp are concave.

8. The discarding sabot projectile as defined in claim 1 wherein said sabot has a length which is less than its bulkhead diameter.

* * * * *